US006036788A

United States Patent [19]

Grisolia

[11] Patent Number: 6,036,788

[45] Date of Patent: Mar. 14, 2000

[54] APPARATUS AND METHOD FOR CLEANSING FISHING REELS

[76] Inventor: George Grisolia, 4935 Lazio Way, Agoura, Calif. 91301

[21] Appl. No.: 09/085,465

[22] Filed: May 27, 1998

Related U.S. Application Data

[60] Provisional application No. 60/049,150, Jun. 10, 1997.

[51] Int. Cl.[7] ..... B08B 3/02

[52] U.S. Cl. ..... 134/31; 134/34; 134/172; 134/198

[58] Field of Search ..... 134/31, 34, 36, 134/172, 198, 199

[56] References Cited

U.S. PATENT DOCUMENTS

| | | | |
|---|---|---|---|
| 214,468 | 4/1879 | Strang | 134/172 X |
| 819,112 | 5/1906 | Wylie | 134/172 X |
| 4,979,677 | 12/1990 | Dankert | 134/172 X |

*Primary Examiner*—Philip R. Coe
*Attorney, Agent, or Firm*—Louis J. Bachand

[57] ABSTRACT

Apparatus and method for cleansing fishing reels by spraying water as a fine, impalpable fog which condenses on the reel and runs off as it coalesces taking salt and other accumulants. The fog does not penetrate into the reel interior as an eventual source of rust and corrosion.

12 Claims, 2 Drawing Sheets

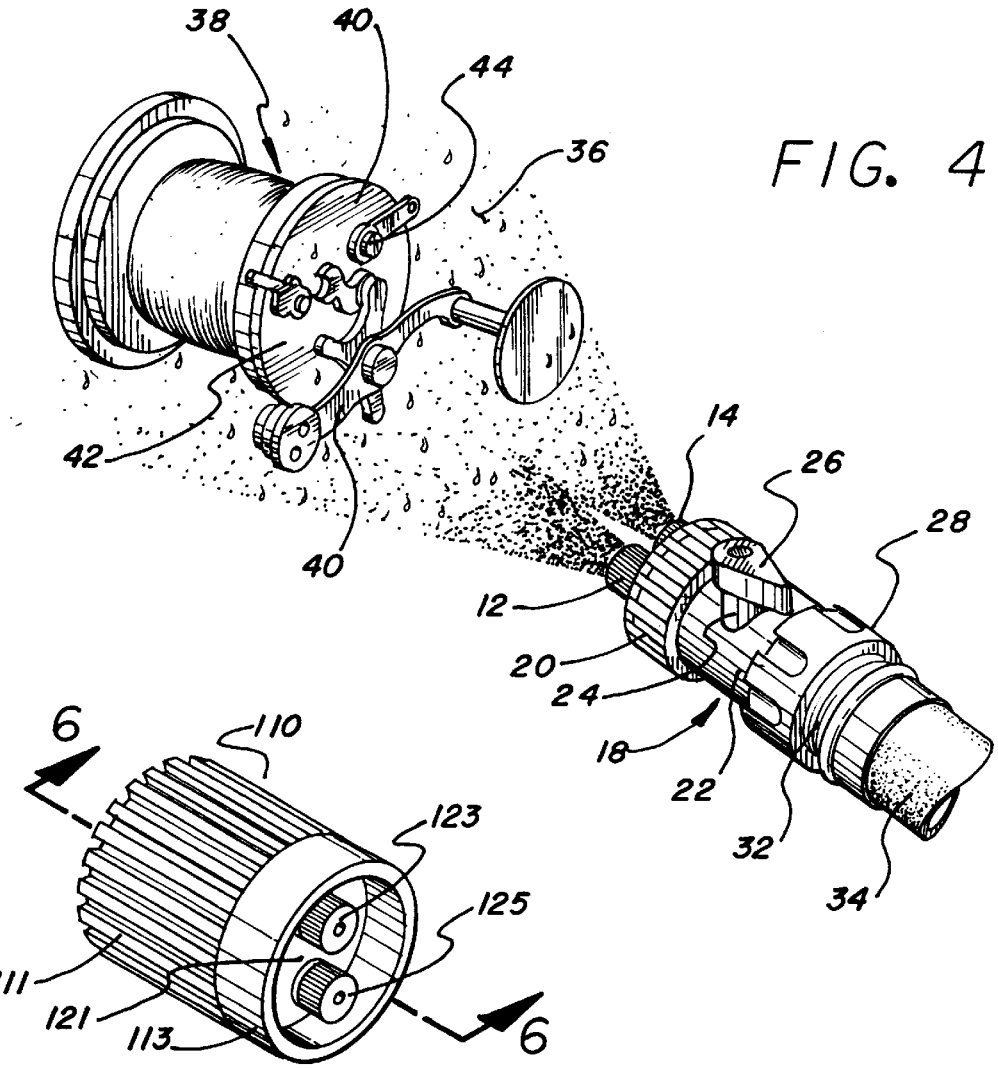
FIG. 4
FIG. 5
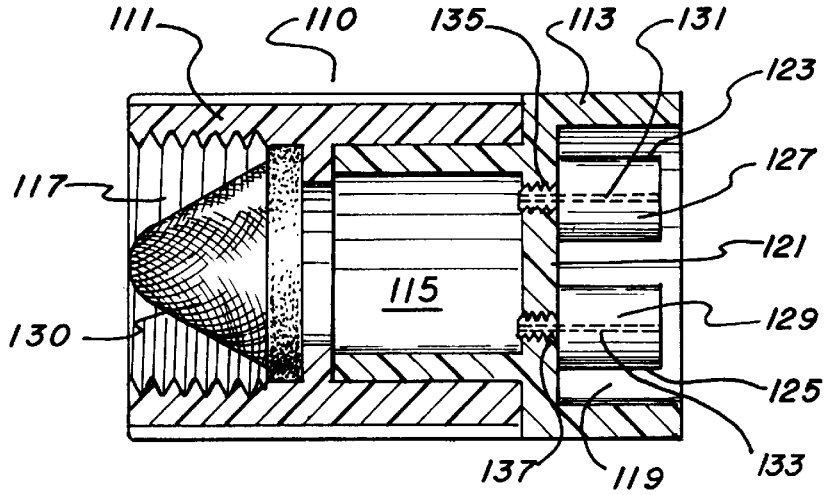
FIG. 6

APPARATUS AND METHOD FOR CLEANSING FISHING REELS

REFERENCE TO RELATED APPLICATIONS

This application claims the benefit of United States Provisional Application 60/049,150 filed on Jun. 10, 1997.

BACKGROUND OF THE INVENTION

1. Field of the Invention

This invention relates to the cleansing of fishing reels, and more particularly to the effective removal of salt and other accumulations from sport fishing reels without ruinous incursions of water into the internal mechanisms of these reels.

2. Related Art

Fishing reels are highly complex assemblies used to control fishing line in the course of fishing. Intricate gearing, precision parts and costly materials of construction make effective routine maintenance of fishing reels essential. Above all, maintenance should not contribute to the destruction of these reels. The most common problem in maintaining fishing reels is cleaning salt and other accumulants from the reel after use. Merely blasting with water will remove the accumulants, but will force water into the internal reel mechanisms, away from air circulation, where rust can develop, with ensuing loss of reel performance and eventually a premature need for replacement of parts.

SUMMARY OF THE INVENTION

It is an object, therefore, of the present invention to provide means of flushing from fishing reel washable surfaces such unwanted accumulants as salt, sand, dirt, and the like with a gentle fog of moisture, so fine as to be impalpable, and so gentle as to not penetrate to the reel inner workings.

This and other objects of the invention to appear hereinafter are realized in an apparatus for the cleansing of fishing reels having washable surfaces tending to gather unwanted accumulants, comprising a connector for connection to a water supply at a predetermined pressure, a nozzle structure communicating with the water supply, the nozzle structure comprising a nozzle support and at least one nozzle having at least a single fine outlet, the nozzle outlet being sized to break up water supply water supplied at the predetermined pressure into a fog of impalpable fineness and sized for bathing the fishing reel in the fog for water condensation thereon in fishing reel washable surface cleansing relation, whereby the fishing reel washable surfaces are washed free of unwanted accumulants without incursions of water into interior portions of the fishing reel.

In a more particular embodiment, the invention provides such an apparatus comprising a plenum body having at one end a threaded connector for connection to a water supply at a predetermined pressure, and at the other end a nozzle structure in open communication through the body with the water supply, the nozzle structure comprising a nozzle support and at least one nozzle having at least a single fine outlet, the nozzle outlet being sized to break up water supply water supplied at the predetermined pressure into a fog of impalpable fineness and sized for bathing the fishing reel in the fog for water condensation thereon in fishing reel washable surface cleansing relation, whereby the fishing reel washable surfaces are washed free of unwanted accumulants without incursions of water into interior portions of the fishing reel.

In this and like embodiments, typically: the plenum body is generally cylindrical, the threaded connector defines an inlet adapted for pressurized water, the nozzle structure includes a transverse wall across the plenum body opposite the inlet and spaced therefrom in plenum defining relation and having at least one aperture, the nozzle structure further including a nozzle mounted in the wall in water passing relation, the nozzle being adapted to break up passing water into the fog; the transverse wall has a plurality of apertures, and the apparatus further comprises a nozzle mounted in each apertures, each nozzle being sized to emit from ¼ to 1.5 gallon of water per hour at water pressures of about 50 pounds per square inch gauge; the plenum body has a flow controller for controlling flow from the inlet to the nozzles, the flow controller comprises a valve body shiftable with the plenum body to block or unblock water flow therethrough, and there is a handle lever for shifting the valve body, and, the plenum body is plastic.

In a highly preferred embodiment, there is provided an apparatus for the cleansing of fishing reels comprising a generally cylindrical plenum body having at one end an inlet surrounded by a threaded hose connector for connection to a water supply hose containing water at a predetermined pressure, the plenum body having at its other end opposite the inlet a transverse wall closing off the plenum body, the transverse wall having therethrough at least one aperture, a nozzle structure in each aperture controlling flow therethrough, each nozzle structure being in open communication through the plenum body with the water supply, the nozzle structure comprising a generally cylindrical nozzle body defining a nozzle passage and nozzle outlet sized to break up water supply water supplied at the predetermined pressure into a fog of impalpable fineness for bathing the fishing reel in the fog for water condensation thereon in fishing reel washable surface cleansing relation, whereby the fishing reel washable surfaces are washed free of unwanted accumulants without incursions of water into interior portions of the fishing reel.

In its method aspects, the invention provides a method of cleansing fishing reels having washable surfaces and unwanted accumulants such as salt thereon, including communicating a nozzle array with a water supply, generating with the nozzle array a water fog of impalpable fineness, supporting the fishing reel briefly within the fog of water, condensing the fog by contact with the fishing reel washable surfaces, and allowing the condensed fog water to drain by gravity across and from the fishing reel washable surfaces in accumulant collecting and removing relation, whereby the fishing reel washable surfaces are rinsed free of unwanted accumulants without forced water incursions into the interior of the fishing reel.

In this and like embodiments, typically, there is included maintaining a plenum for accumulation of water under pressure, communicating the nozzle array with the water in the plenum, and expressing the plenum water from the nozzle array, maintaining a flow control between the water supply and the plenum, and controlling the volume of water entering the plenum with the flow control, maintaining at least a first and second nozzle in the nozzle array, separating the nozzles by a distance increasing the area of water fog generation sufficiently to encompass the fishing reel, dividing the water within the plenum substantially equally between the nozzles, and expressing the water substantially equally from the nozzles of the nozzle array.

BRIEF DESCRIPTION OF THE DRAWINGS

The invention will be further described in conjunction with the attached drawings in which:

FIG. 4 is a perspective view of the apparatus in use

FIG. 5 is a perspective view of an alternate form of the invention; and,

FIG. 6 is a view taken on line 6—6 in FIG. 5.

DESCRIPTION OF THE PREFERRED EMBODIMENTS

Figure 1:
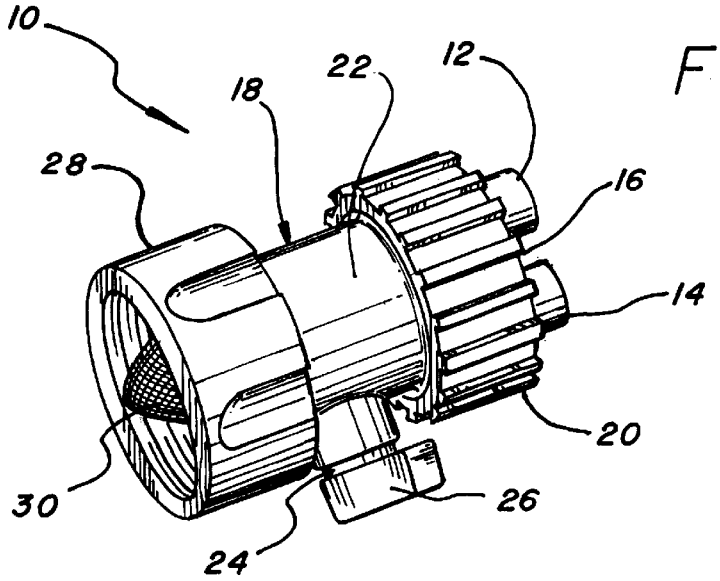
FIG. 1 is a perspective view of my fishing reel cleansing invention.
Figure 2:
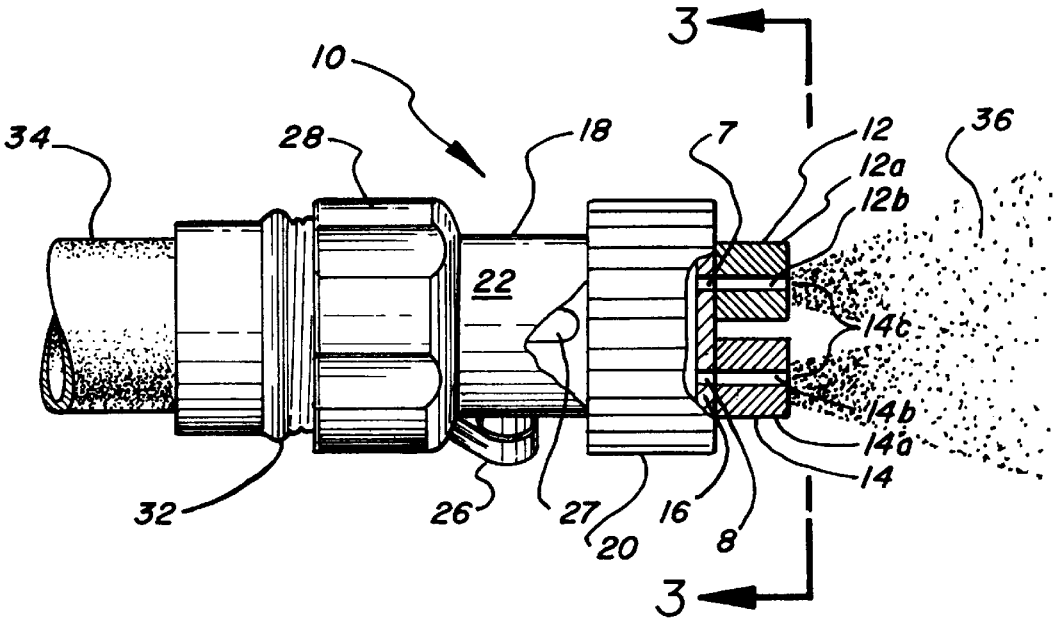
FIG. 2 is a side elevational view thereof.
Figure 3:
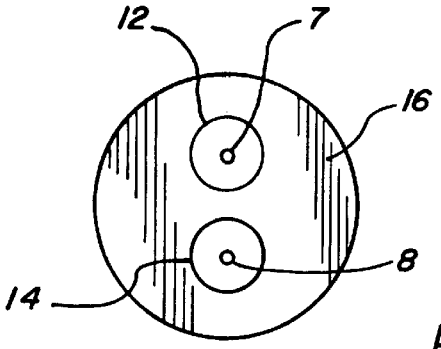
FIG. 3 is a view taken on line 3—3 in FIG. 2.

With reference now to the drawings in detail, FIGS. 1–3 show a connector 10 for connection to a water supply such as coupling 32 on hose 34. Connector 10 has a transverse wall 16 with diametrically spaced first and second through apertures 7, 8. First and second nozzle structures 12, 14 comprising a nozzle body 12*a*, 14*a* and nozzle passages 12*b* and 14*b* are mounted in the transverse wall apertures 7, 8. The wall 16 is supported in the cylindrical plenum body 18 portion of the connector 10 and is captured there by front cap 20 threaded onto the cylindrical body. The throat 22 of cylindrical plenum body 18 is laterally ported to admit valve stem 24 operated by lever handle 26 for purposes of opening or closing a valve body 27 controlling water passage within the cylindrical plenum body. Rear cap 28 is thread-mounted onto the cylindrical plenum body 18 and retains conical screen 30 in place to strain water entering the cylindrical body.

The nozzle structures 12, 14 connect via rear cap 28 to the hose coupling 32 of hose 34 to communicate the nozzle passages 12*b*, 14*b* with the water supply. Water is supplied at a predetermined pressure gauged to be sufficient, e.g. 40 to 75 pounds per square inch gauge to fog the water ejected through nozzles passages 12*b*, 14*b*. Water delivery is at the rate of ¼ to 1.5 gallon per hour. The nozzle openings 12*c*, 14*c* are set at a size and shape to generate a fine mist or fog and avoid coherent streams. The fog sought herein is so fine as to be impalpable; that is, the droplets of water are so small that there is no sensation of impact when they strike the open palm.

In FIGS. 5 and 6, an alternate form of the invention is shown having a connector 110 comprising a left element 111 (as viewed in the drawing) externally knurled and internally threaded to connect to a hose end (not shown) with conical screen 130 in place to intercept debris, and a right element 113 interfitted with the left element. Right element 113 defines with left element 111 a through passage 115 from the inlet 117 to the nozzle structure 119. Nozzle structure 119 comprises transverse wall 121 and first and second nozzles 123, 125, each comprising a cylindrical body 127, 129 forming a nozzle passage 131, 133, and having a threaded connector 135, 137 thereon for threaded engagement with the transverse wall 121. Cleansing operations with this embodiment are the same as the previous embodiment and will now be described.

With reference now to FIGS. 2 and 4, the fog 36 emanating from the nozzles structures 12, 14 condenses on the fishing reel 38, creating in situ a fine sheen of water on the reel, which coalesces with added water to run on and drip from the washable surfaces 40 of the reel. The sheeting effect of the applied water is such that the water typically spans, through surface tension, the small gaps in the reel walls 42 at the situs of through-the-reel wall shafts such as shaft 44.

It will be noted that no invasive streams of water are projected onto the reel 38, saving the reel from incursions of water into the reel interior and the eventual rusting and corrosion of the precision parts therein.

The connector, the nozzle structure and all other stationary parts of the apparatus can be molded as a unitary body having the nozzles coplanar with the face of the body, the hose end coupling integral with the body, the body sides knurled, and the filtering screen captured within the body. Other forms of the invention can also be used.

I claim:

1. Apparatus for the cleansing of fishing reels having washable surfaces tending to gather unwanted accumulants, comprising a connector for connection to a water supply at a predetermined pressure, a nozzle structure communicating with said water supply, said nozzle structure comprising a nozzle support and at least one nozzle having at least a single fine outlet, said nozzle outlet being sized to break up water supply water supplied at the predetermined pressure into a fog of impalpable fineness and sized for bathing the fishing reel in said fog for water condensation thereon in fishing reel washable surface cleansing relation, whereby said fishing reel washable surfaces are washed free of unwanted accumulants without incursions of water into interior portions of said fishing reel.

2. Apparatus for the cleansing of fishing reels having washable surfaces tending to gather unwanted accumulants, comprising a plenum body having at one end a threaded connector for connection to a water supply at a predetermined pressure, and at the other end a nozzle structure in open communication through said body with said water supply, said nozzle structure comprising a nozzle support and at least one nozzle having at least a single fine outlet, said nozzle outlet being sized to break up water supply water supplied at said predetermined pressure into a fog of impalpable fineness and sized for bathing said fishing reel in said fog for water condensation thereon in fishing reel washable surface cleansing relation, whereby said fishing reel washable surfaces are washed free of unwanted accumulants without incursions of water into interior portions of said fishing reel.

3. Apparatus according to claim 2, in which said plenum body is generally cylindrical, said threaded connector defining an inlet adapted for pressurized water, said nozzle structure including a transverse wall across said plenum body opposite said inlet and spaced therefrom in plenum defining relation and having at least one aperture, said nozzle structure further including a nozzle mounted in said wall in water passing relation, said nozzle being adapted to break up passing water into said fog.

4. Apparatus according to claim 3, in which said transverse wall has a plurality of apertures, and said apparatus further comprising a nozzle mounted in each said apertures, each nozzle being sized to emit from ½ to 1 gallon of water per hour at water pressures of about 50 pounds per square inch gauge.

5. Apparatus according to claim 3, in which said plenum body has a flow controller for controlling flow from said inlet to said nozzles, said flow controller comprising a valve body shiftable with said plenum body to block or unblock water flow therethrough, and a handle for shifting said valve body.

6. Apparatus according to claim 4, in which said plenum body is plastic.

7. Apparatus for the cleansing of fishing reels having washable surfaces tending to gather unwanted accumulants, comprising a generally cylindrical plenum body having at one end an inlet surrounded by a threaded hose connector for connection to a water supply hose containing water at a predetermined pressure, said plenum body having at its other end opposite said inlet a transverse wall closing off said plenum body, said transverse wall having therethrough at least one aperture, a nozzle structure in each said aperture controlling flow therethrough, each said nozzle structure being in open communication through said plenum body with said water supply, said nozzle structure comprising a generally cylindrical nozzle body defining a nozzle passage and nozzle outlet sized to break up water supply water supplied at said predetermined pressure into a fog of impalpable fineness for bathing said fishing reel in said fog for water condensation thereon in fishing reel washable surface cleansing relation, whereby said fishing reel washable surfaces are washed free of unwanted accumulants without incursions of water into interior portions of said fishing reel.

8. Method of cleansing fishing reels having washable surfaces and unwanted accumulants such as salt thereon, including communicating a nozzle array with a water supply, generating with said nozzle array a water fog of impalpable fineness, supporting said fishing reel briefly within said fog of water, condensing said fog by contact with said fishing reel washable surfaces, and allowing the condensed fog water to drain by gravity across and from the fishing reel washable surfaces in accumulant collecting and removing relation, whereby said fishing reel washable surfaces are rinsed free of unwanted accumulants without forced water incursions into the interior of said fishing reel.

9. The method according to claim 8, including also maintaining a plenum for accumulation of water under pressure, communicating said nozzle array with said water in said plenum, and expressing said plenum water from said nozzle array.

10. The method according to claim 9, including also maintaining a flow control between said water supply and said plenum, and controlling the volume of water entering said plenum with said flow control.

11. The method according to claim 8, including also maintaining at least a first and second nozzle in said nozzle array, separating said nozzles by a distance increasing the area of water fog generation sufficiently to encompass said fishing reel.

12. The method according to claim 11, including also maintaining a plenum for accumulation of water under pressure, communicating said nozzle array with said water in said plenum, dividing the water within said plenum substantially equally between said nozzles, and expressing said water substantially equally from said nozzles of said nozzle array.

* * * * *